United States Patent [19]

Hoover et al.

[11] 4,096,949

[45] Jun. 27, 1978

[54] APPARATUS FOR PERFORMING A THREE-WAY SORT

[75] Inventors: Michael C. Hoover; William C. Long, both of Houston, Tex.

[73] Assignee: Geosource Inc., Houston, Tex.

[21] Appl. No.: 691,908

[22] Filed: Jun. 1, 1976

[51] Int. Cl.[2] ..... B07C 5/342

[52] U.S. Cl. ..... 209/74 M; 209/75; 209/111.6; 209/111.7 T; 250/223 R; 250/226; 356/173

[58] Field of Search ..... 209/74 R, 74 M, 75, 209/111.6, 111.7 T; 356/173, 201; 250/223 R, 226

[56] References Cited

U.S. PATENT DOCUMENTS

| | | | |
|---|---|---|---|
| 3,565,535 | 2/1971 | Monell | 356/201 |
| 3,619,612 | 11/1971 | Belke et al. | 73/136 A X |
| 3,802,558 | 4/1974 | Rhys | 209/75 |
| 3,914,601 | 10/1975 | Hoover et al. | 250/226 |
| 3,980,180 | 9/1976 | Jamieson | 209/111.6 |

*Primary Examiner*—Robert B. Reeves
*Assistant Examiner*—Joseph J. Rolla
*Attorney, Agent, or Firm*—Arnold, White & Durkee

[57] ABSTRACT

Apparatus for three-way sorting of particles in a singulated particle stream is characterized by a viewing assembly including a first and a second classifying section each respectively classifying each particle passing therethrough according to first and second predetermined physical characteristics, such as opaqueness and color, and generating an appropriate classification signal representative thereof. The classification signals so generated are transmitted through an appropriate signal delay circuit to actuator circuits which actuate ejector elements. Actuation of the appropriate ejector in response to a classification signal directs certain of the particles exhibiting the first and the second physical characteristics out of the singulated stream and into respective collection receptacles while others of the particles are permitted to pass unimpeded to a separate collection area. An electronic circuit associated with each ejector actuator permits actuation of only one of the ejectors in the event that a particular particle within the stream has been classified for ejection by both the classifying sections.

16 Claims, 8 Drawing Figures

| SITUATION | SET PIN 7, OPAQUE | RESET PIN 4, COLOR | Q PIN 1 |
|---|---|---|---|
| NORMAL | 0 | 1 | 0 |
| COLOR ONLY | 0 | 0 | 0 |
| COLOR ENDS | 0 | 1 | 0 |
| NORMAL | 0 | 1 | 0 |
| COLOR & OPAQUE | 1 | 0 | 1 |
| BOTH END TOGETHER | 0 | 1 | 0 |
| NORMAL | 0 | 1 | 0 |
| COLOR & OPAQUE | 1 | 0 | 1 |
| OPAQUE ENDS COLOR CONTINUES | 0 | 0 | 1 (NO CHANGE FROM PREVIOUS STATE) |
| COLOR ENDS | 0 | 1 | 0 |
| NORMAL | 0 | 1 | 0 |
| COLOR & OPAQUE | 1 | 0 | 1 |
| COLOR ENDS OPAQUE CONTINUES | 1 | 1 | 1 (NO CHANGE FROM PREVIOUS STATE) |
| OPAQUE ENDS | 0 | 1 | 0 |

FIG. 6

APPARATUS FOR PERFORMING A THREE-WAY SORT

BACKGROUND OF THE INVENTION

1. Field of the Invention

This invention relates to sorting apparatus capable of providing a three-way sort, and, in particular, to a sorting apparatus for isolating, during one pass only, clear particles of glass from opaque particles and colored glass particles.

2. Description of the Prior Art

The recent awareness generated by ecological and energy considerations has manifested itself in the glassmaking industry by the realization that several important ecological, energy, and economic advantages may be obtained by the recycling of glass. The ecological aspect is well documented and follows directly from the fact that putting the discarded glass material to a productive use lessens the ecological impact of discarded glass products. Economically, the glass industry has found that the use of recycled glass cullett, that is, small glass particles, provides advantages both in the cost of materials for glass manufacturers and in capital expenditures required to maintain the glassmaking furnaces. It is found that the price of such cullett is less than the price of raw material. Mixture of the recycled cullett with the virgin glassmaking materials permits use of a lesser amount of raw material and also increases heat conduction during the glassmaking process, prolonging the life of the refractory lining of the glass furnace. Thus, the ability to provide a source of recycled glass cullett from heretofore refuse glass articles is economically advantageous in its own right.

However, it is found that random utilization of any glass particle in any glass furnace is not advantageous. Due to the particular chemical reactions occurring within glass furnaces, it has been noted that only particular glass particles may advantageously be utilized in the production of certain final glass products. For example, it is known that any colored glass particles may advantageously be utilized in the production of a newly manufactured colored glass. Similarly, clear glass particles (with some minor exceptions) may be utilized in those furnaces generating newly made clear glass. Since approximately 65% of all glass manufactured in this country is clear glass, it becomes necessary to provide an arrangement whereby the colored glass particles can economically be separated from the clear glass particles.

Contemporary interest in recycled glass particles is only one aspect of a new awareness for the recycling of as much solid waste material as possible. Therefore, increasing awareness has been aroused in one area, namely the area of municipal solid waste recovery programs, to extract from the literally mountains of waste generated each day recyclable and reusable solid materials.

A typical solid waste recovery program acts on the collected refuse to shred and render particulate that refuse prior to the passage thereof through a multistage mechanical separation system. Typically, after shredding, the first stage of such a recovery system is the passage of the refuse through an air classifier in which the lighter of the refuse particles, such as paper, is separated from the heavier particles including metal, glass, and ceramic particles. Other means, such as a magnetic sort or a heavy media flotation arrangement, may be utilized to respectively isolate ferrous material or other solid waste classifications from the remainder of the refuse. Alternatively, electrostatic separation, in which the particulate matter is conducted over a cylindrical drum and an electrostatic charge imparted thereto has been found viable. The conductive material quickly dissipates the charge while the nonconductive material holds the charge and is caused to adhere to the drum where suitable scrapers are provided to eliminate it from the drum.

By whatever means is utilized, the net result is a mass of particulate solid waste of a nonconductive nature, such as brick, ceramic tile, and glass particles, isolated from the ferrous or conducting particles and the other waste particles. It is at this point in the process that an apparatus to separate the so-called "glass fraction" (that is, the mixture of glass particles and ceramic and other nonconductive particles) into a form of cullett utilizable by a glass manufacturer in the production of glass products is particularly useful.

The prior art discloses a variety of devices operable to provide a two-way article sort based on various physical parameters. For example, U.S. Pat. No. 3,197,647 (Fraenkel) provides a photosensitive apparatus for two-way sorting of translucent objects. The patents to Hutter, U.S. Pat. Nos. 3,011,634 and 3,179,247, disclose apparatus for two-way sorting of mineral particles and of rock salt, respectively. The patents to Nelson, U.S. Pat. No. 3,385,434, and Gray, U.S. Pat. No. 3,880,289, both relate to the sorting of field corn kernels from sweet corn kernels according to ratios of signals indicative of their internal consistency.

In the area of refuse classification, the patent to Gillespie, U.S. Pat. No. 3,650,396, discloses an arrangement providing a two-way sort of previously isolated glass particles into clear and colored bins. The elimination of other waste products is provided upstream of the glass sort, as by pneumatic separation.

The patent to Rhys, U.S. Pat. No. 3,802,558, discloses a refuse separation system operable to eliminate opaque, colored, and clear particles in which the opaque particle and colored glass detectors are pitched so that interference by one detector with the sorting procedures of the other does not occur. The ejectors are located orthogonal to each other and no inhibitor circuitry is provided to inhibit the actuation of one ejector with respect to the other.

It would, therefore, be advantageous to provide a sorting apparatus able to provide a three-way particle sort (such as clear glass, colored glass, and opaque matter) during one particle pass through the apparatus. It would also be advantageous to provide a sorting apparatus having inhibitor circuitry which permits the firing of only one of an array of ejector elements in the situation where a particular particle generates an eject classification from more than one classifier.

SUMMARY OF THE INVENTION

This invention relates to a sorting apparatus capable of providing a three-way particle sort in a single pass, for example, sorting a singulated stream of particles into fractions of opaque particles, clear glass particles and colored glass particles, according to the translucence characteristics thereof. An inclined slide generates a singulated particle stream containing, in random serial disposition, clear glass particles, colored glass particles, and opaque foreign particles. The particles have been presized to approximately ¼ to ¾ inch sizes. The particles are conducted from a hopper to the inclined side by a chute, and are permitted to fall freely through a viewing and classification assembly.

The viewing and classification assembly comprises a first and a second classifying means stacked one above the other. The first classifying means generates a classification signal indicative of the opaqueness of the particle viewed. The second classifying means generates a classification signal dependent upon the color characteristics of the particle. The classification signals so generated are delayed for a predetermined period of time corresponding to the time required for the viewed particles to pass in free-fall from the viewing arrangement to the proximity of a plurality of ejectors. The ejectors are actuated by ejector actuator circuits in response to the appropriate classification signal to expel opaque and colored glass particles from the singulated stream into their appropriate receptacles. The clear glass particles are permitted to pass unimpeded to a separate collection receptacle.

Inhibitor circuitry associated with the ejector actuators is provided to prevent the simultaneous firing of ejectors when simultaneous classification signals corresponding to opaque and colored glass particles are received by the actuators. The inhibitor circuitry is arranged so that any particle which generates eject classifications from both the first and second classifying means is ejected by operation of the ejector associated with the opaque classifying means. Only this ejector is actuated to expel that particular particle from the singulated stream into the opaque particle receptacle.

BRIEF DESCRIPTION OF THE DRAWINGS

The invention will be more fully understood from the following detailed description of a preferred embodiment thereof, taken in connection with the accompanying drawings in which.

DESCRIPTION OF THE PREFERRED EMBODIMENT

Figure 1:
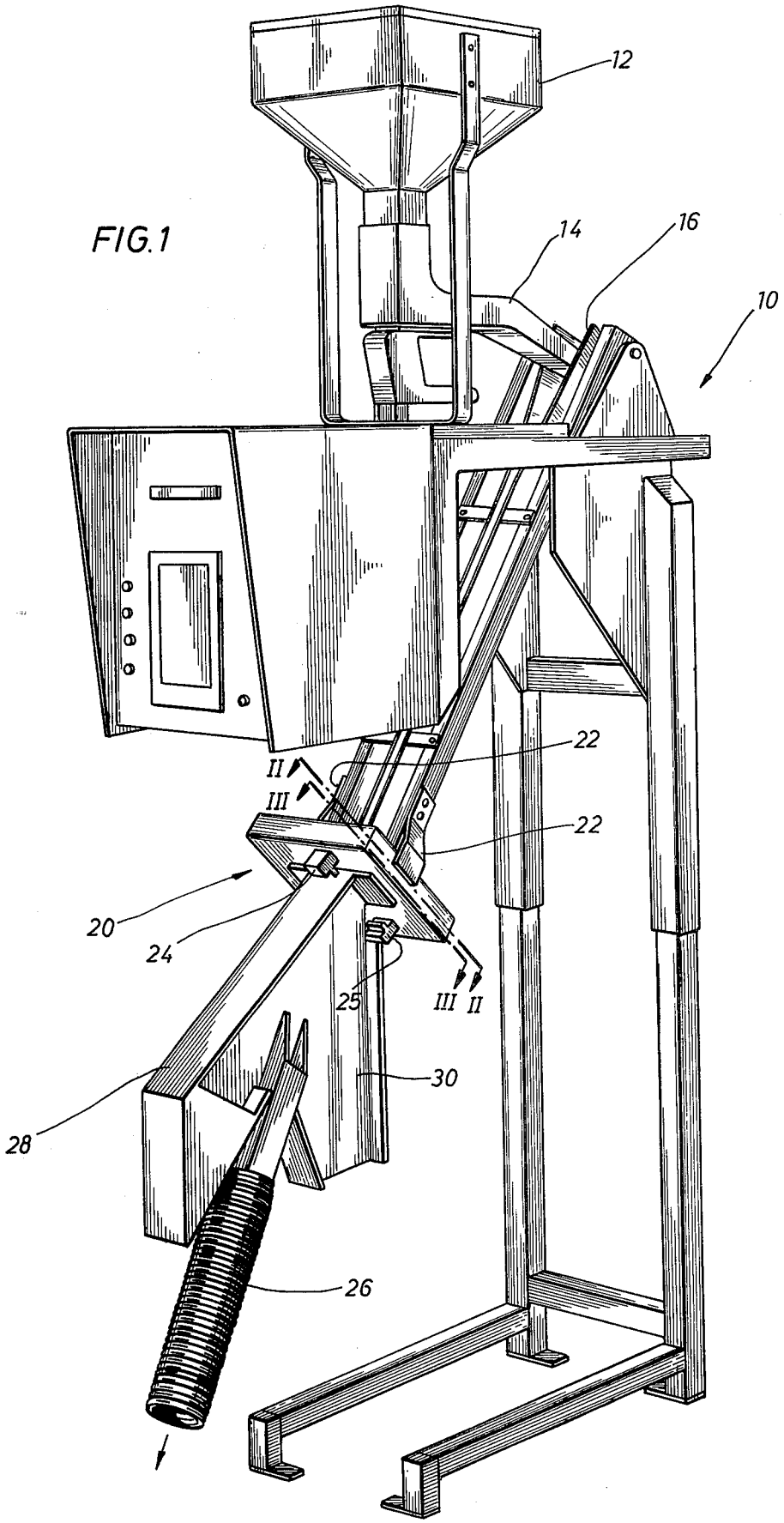
FIG. 1 is a perspective view of a single channel glass sorting machine in accordance with the preferred embodiment of the invention.

Throughout the following description similar reference characters refer to similar elements in all figures of the drawings.

Referring first to FIG. 1, a sorting apparatus 10 embodying the teachings of this invention includes a hopper 12 associated with a vibrating chute 14. One end of the chute 14 is connected to the outlet of the hopper 12 while the second end of the chute 14 is disposed so as to feed into an inclined slide arrangement 16. The apparatus 10 embodying the teachings of this invention is able to provide a three-way sort of particles with one pass of the particles therethrough. For example, the apparatus 10 sorts a singulated stream of glass particles into three predetermined groups, based upon the clearness, the opaqueness, and the color characteristics of each particle. If glass particles are to be sorted by the apparatus 10, the glass particles are loaded into the hopper 12. The vibrating chute 14 and the slide 16 combine to provide means for gravity assisted singulation of the particles as the particles slide downwardly thereon. The slide 16 is, in cross-section, substantially V-shaped with a radius portion connecting the lower ends of both arms of the V. The slide 16 is preferably fabricated of a material of sufficient hardness to prevent the jagged edges of the glass particles in the singulated paticle stream from digging into and being turned by reactions with the slide. A suitable material has been found to be a hard anodized aluminum fabricated by the oxidation of an aluminum member so as to provide a surface or coating of aluminum oxide thereon sufficient to be substantially impervious to the cutting and grating edges of the singulated glass particles. The object of the cooperative association of the hopper 12, chute 14, and slide 16 is to provide a well-defined stream of particles to be sorted as those particles slide (rather than tumble) down the slide 16. Of course, any other suitable means may be utilized to provide a singulated stream of particles.

Figure 4:
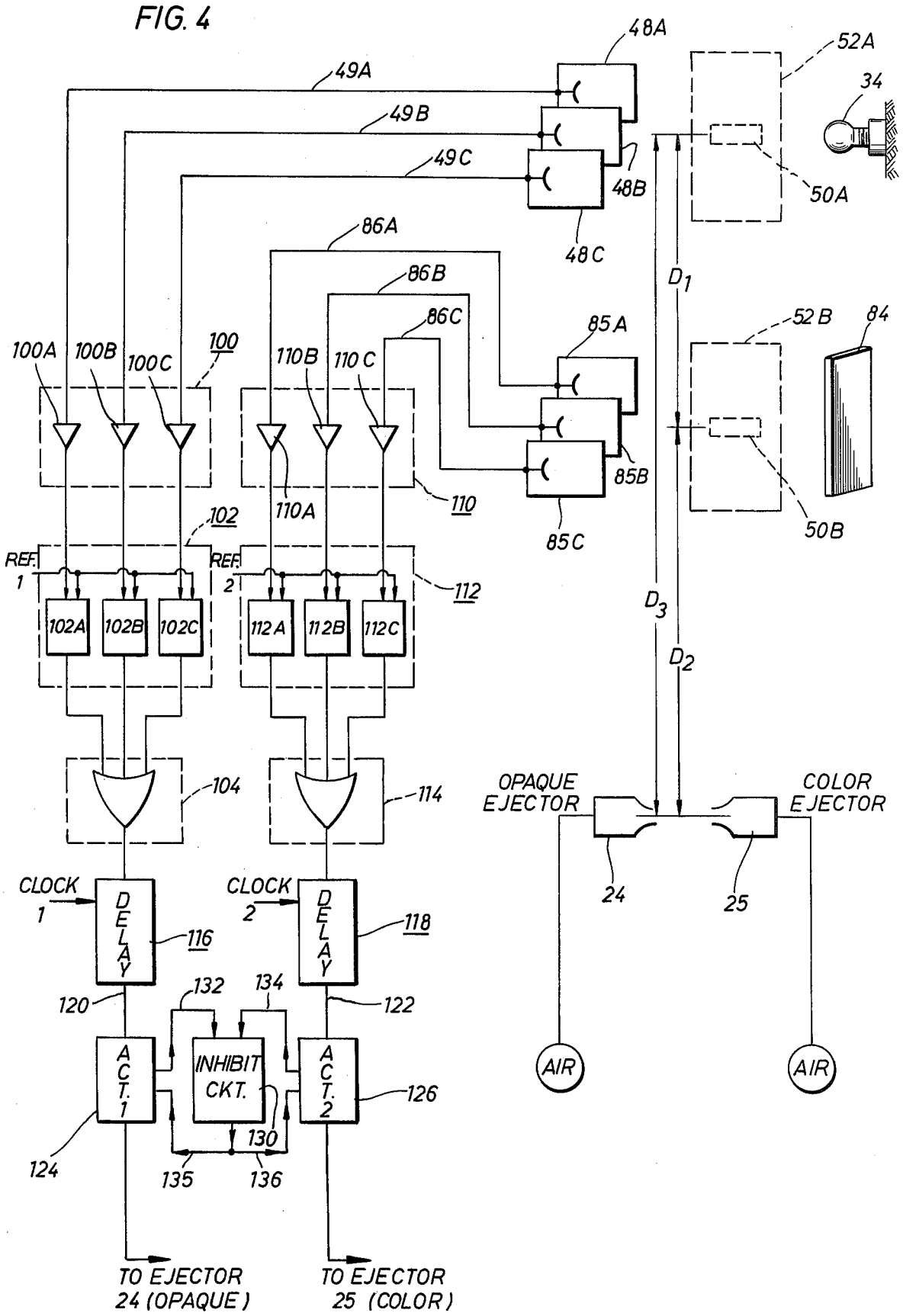
FIG. 4 is a diagrammatic representation of the electronic and structural elements of a sorting apparatus embodying the teachings of this invention.

At the bottom terminus of the slide 16, the particles to be sorted shoot out with a considerable velocity on a predetermined trajectory which is substantially a straight prolongation of the slide 16 for a short distance. Adjacent the bottom of the slide 16 a viewing assembly (generally indicated by reference numeral 20) is secured, as by suitable mounting brackets 22. Ejector elements 24 and 25 (as seen in FIGS. 1 and 4) are provided below the viewing assembly 20, and are operable in a manner discussed more fully herein in response to classification signals generated by the viewing assembly 20 in order to deflect selected particles from the singulated stream as those particles pass from the viewing assembly 20. The ejectors are connected to a suitable air supply (FIG. 4). Desired particles, in this instance clear glass particles, continue their substantially free-fall downward flight through an acceptance tube 26 to a suitable receptacle (not shown). Particles deflected by one or the other of the appropriately activated ejectors 24 or 25 pass through respective deflector chutes 30 and 28 to other appropriate receptacles (not shown).

The viewing assembly, or "light box" 20 includes first and second classifying means, or viewers, each operable for classifying each particle passed therethrough according to a selected physical characteristic of the particle such as, for example, the light transmitted through the particle. The first and second classifying means of the illustrated embodiment of this invention, arranged pancake style one above the other in the assembly 20, respectively classify each particle on the basis of its opaqueness and color.

Figure 2:
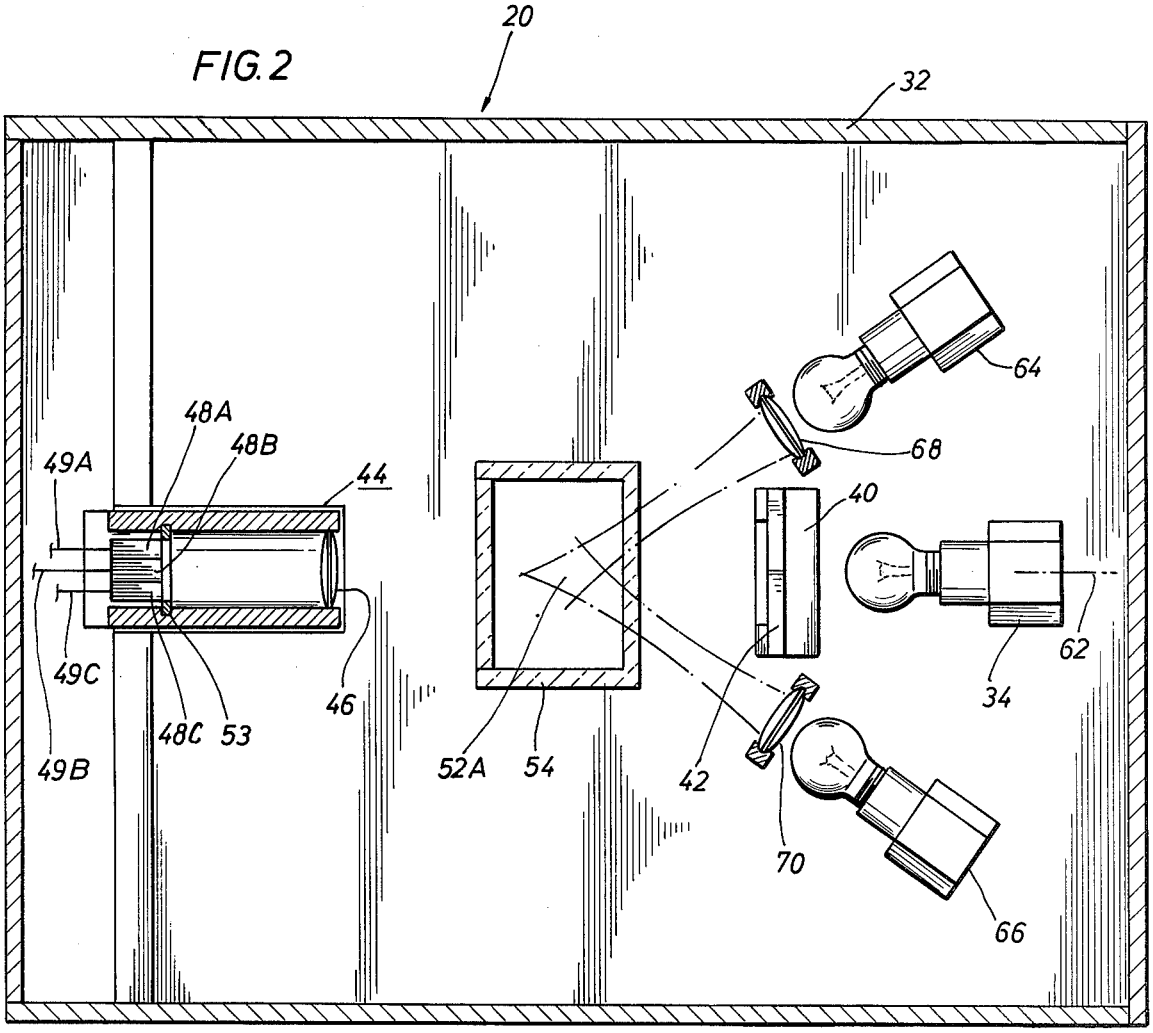
FIGS. 2 and 2A are, respectively, a plan view taken along lines II—II of FIG. 1 and an elevation view illustrating a portion of the viewing assembly of a sorting apparatus embodying the teachings of this invention.

Referring now to FIG. 2, a portion of the viewing assembly 20 embodying the teachings of this invention is shown substantially in plan. The assembly 20 comprises a housing 32 in which are received an opaque classifying means and a color classifying means. It is, of course, understood that either classifying means, or viewer, may be disposed above the other within the assembly 20 within the teachings of this invention. The opaque viewer is shown in plan in FIG. 2 while FIG. 2A is an elevational view thereof.

Figure 2A:
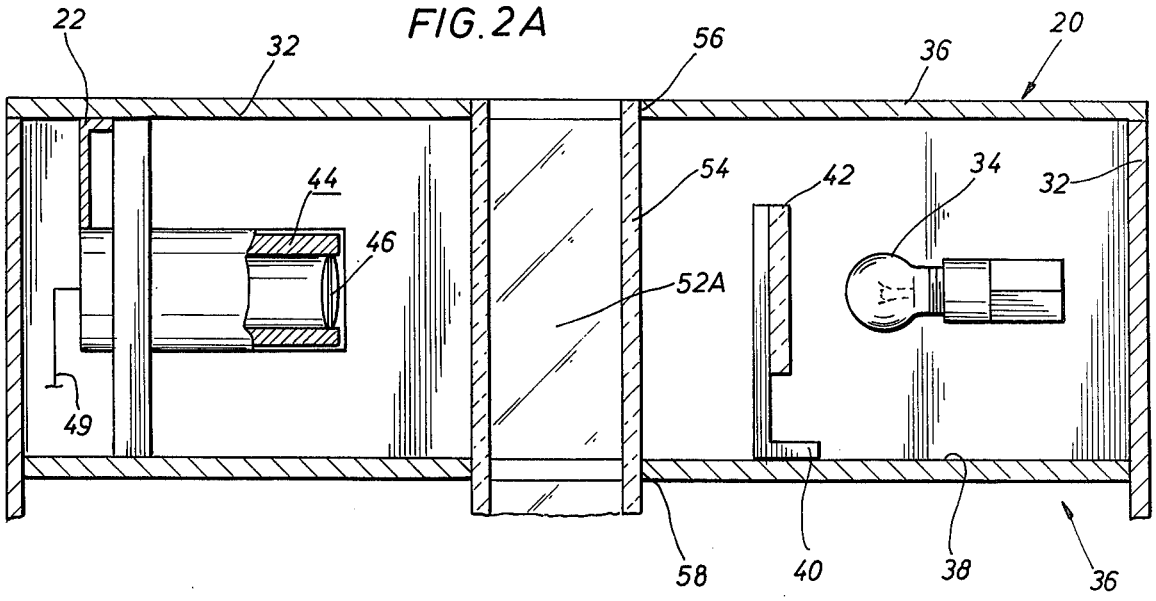

As seen in FIGS. 2 and 2A, the opaqueness classifying means disposed within the viewing assembly 20 includes background illumination means for providing a background illumination level of predetermined intensity, for example, an incandescent lamp 34, suitably mounted within a portion of the housing 32 defined by the upper cover 36 and a central partition 38. Provided on brackets 40 associated with the housing 32 and immediately in front of the background lamp 34 is a frosted glass pane 42. Diametrically opposed from the background lamp 34 and the pane 42 is an opaqueness sensing element 44 comprising a lens member 46 securely mounted therewithin. Associated with the opaqueness sensing element 44 is a solar cell 48 comprising three adjacent panels 48A, 48B, and 48C, as best shown in FIG. 2. The output leads 49A, 49B, and 49C from the respective cells 48A, 48B, and 48C are connected to electronic circuitry described more fully herein. The lamp 34 and opaqueness sensing element 44 are arranged so that when no particles are present in a predetermined viewed area within a central viewing zone 52A, the outputs of the solar cells 48A, 48B and 48C are functionally related to the illumination provided by the incandescent background lamp 34. An optical frame 53 is provided within the opaqueness sensing element 44 and defines the predetermined area viewed by the solar cells 48A, 48B, and 48C. Cited only as a typical example, the solar cells 48 may be limited by the optical frame 53 to view an area approximately 1/16 inch high by ⅜ inch wide. It will be appreciated that the solar cells 48 need not view the entirety of the particle in order to generate the classification signal. The viewing zone 52A is enclosed by a substantially rectangular, clear plastic element 54 secured in any suitable manner to the cover 36 about an aperture 56 therein, and which passes through an aperture 58 in the central partition 38.

Located equiangularly with respect to an axis 62 passing through the background lamp 34 and the opaqueness sensing element 44 are secondary lamp elements 64 and 66, both incandescent lamp elements, mounted in any suitable manner within the housing 32. Provided in cooperative association with the lamp elements 64 and 66 are lens members 68 and 70, respectively arranged to focus the light energy produced thereby within the viewing zone 52A. The secondary lamp elements 64 and 66 are provided for a particular purpose, as follows: If only the background lamp 34 were used, a particle of glass falling between the background lamp 34 and the opaqueness sensing element 44 might cause light from the lamp 34 to be dispersed and not transmitted to the solar cells 48. This attenuation of light would result in the particle being classified as opaque despite its actual physical characteristic. When no particle is in the viewed area of the viewing zone 52A, the cells 48 are not affected by the lamps 64 and 66. However, if a glass particle enters the viewed area and attentuates the light from the lamp 34, such a particle will disperse light from the lamps 64 and 66 toward the cells 48. This light dispersed from the lamps 64 and 66 is equal to or greater than the light received by the cells 48 when no particle is in view. Thus a clear or a colored glass particle will pass without generation of a classification signal. An opaque particle, on the other hand, would block light from the lamps 34, 64 and 66, and thus be classified as opaque.

It is noted that the provision of the clear plastic element 54 with a rectangular cross-section (plan view) avoids any reflection of light energy from the secondary lamps which may generate an erroneous reading. The use of a cylindrical or a substantially circular viewing tube at times has a tendency to reflect light from one of the secondary lamps onto the surface of an opaque object diametrically closest to the opaqueness sensing element 44, making it appear to the solar cells 48 that the particle is translucent although in fact opaque. This problem is avoided by provision of the rectangular, clear plastic element 54.

The provision of a segmented solar cell arrangement comprising the plurality of cells 48A, 48B, and 48C defines with better resolution the opaqueness or translucency of a particle passing through the viewed area. Some of the particles may be too small to completely fill the entire viewed area, and, therefore, would not effectively block a single integrated solar cell. The provision of a plurality of solar cells enhances the ability of the apparatus to determine the opaqueness of an article passing therethrough since the particle need only interfere with the light received by any one of the cells 48. It will be appreciated that although the lamps 34, 64, and 66 have been described as incandescent lamps for use in a glass sorting environment, any suitable illumination means compatible with the requirements of a particular sort may be utilized.

Figure 3:
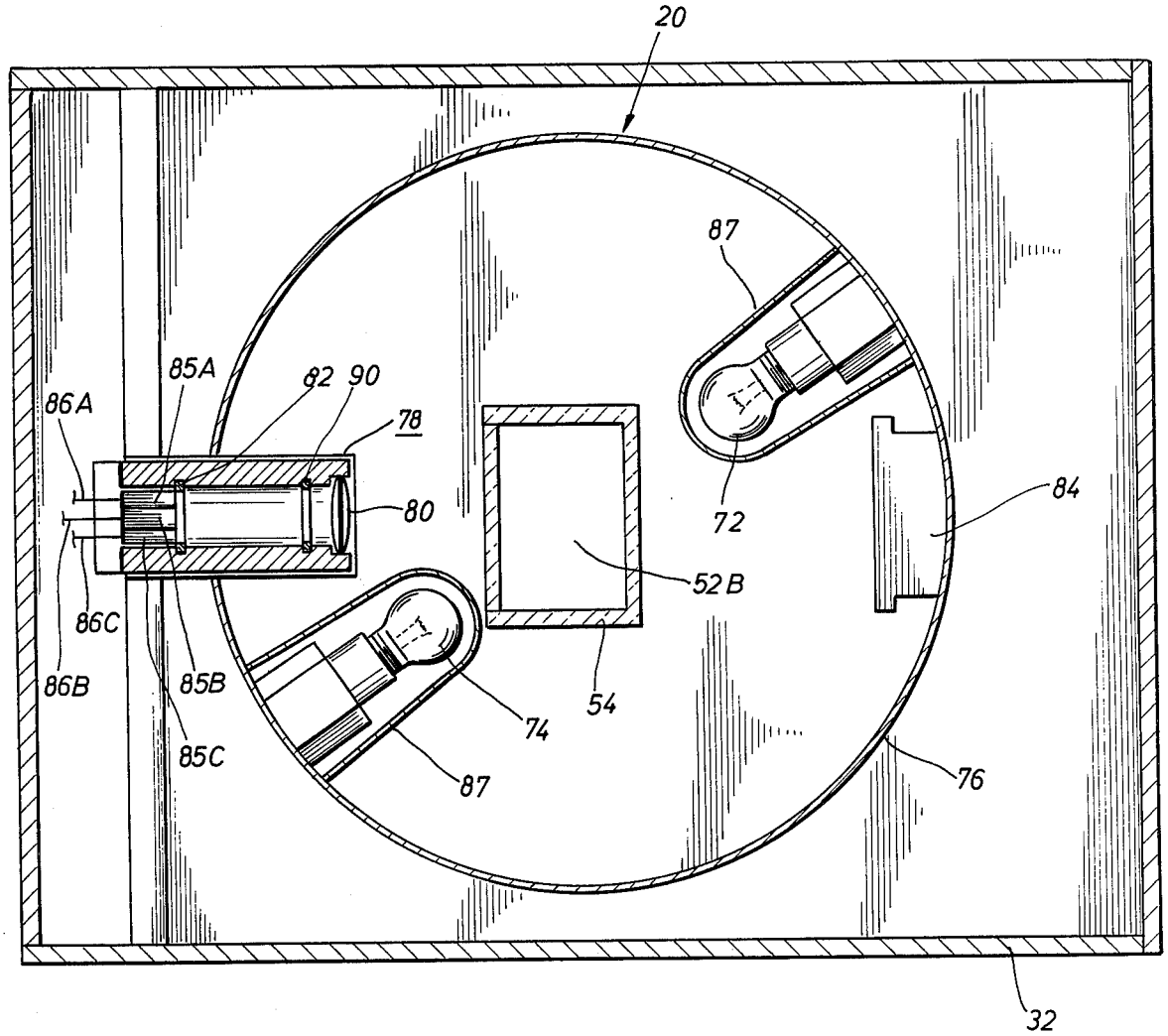
FIGS. 3 and 3A are views similar to FIGS. 2 and 2A showing, respectively, a plan and an elevation view of a second portion of a viewing assembly of a sorting apparatus embodying the teachings of this invention.
Figure 3A:
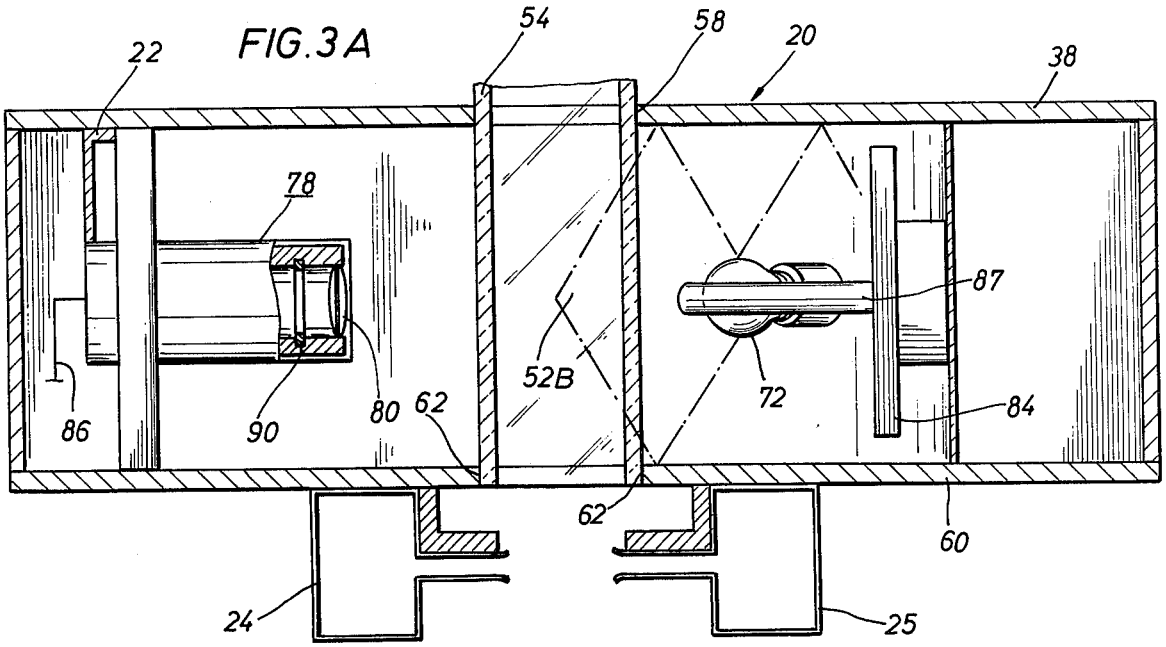

Turning now to FIGS. 3 and 3A, the second, color classifying means of the viewing assembly 20 is disclosed. The second classifying means, the color viewer, is defined in the lower portion of the assembly 20 by the central partition 38 and a lower plate 60. The clear plastic element 54 passes through the aperture 58 in the partition 38 and through the lower color viewer to its secured position adjacent an aperture 62 in the lower plate 60. The color viewer includes background illumination means for providing a background illumination level of predetermined intensity, such as first and second incandescent lamp elements 72 and 74, respectively mounted in a central cylindrical reflector 76 and a reflecting background member 84. A color sensing element 78, comprising a lens 80 and an optical frame 82, is provided diametrically across from the background member 84 as best shown in FIG. 3. A plurality of solar cells 85A, 85B, and 85C, again provided for the reasons above discussed, have leads 86 connected to the electronic circuitry of the apparatus. The optical frame 82 defines a predetermined area viewed by the solar cells 85 within a viewing zone 52B in the lower, color classifying means. Cited only as a typical example, the solar cells 85 may be limited by the optical frame 82 to view the area approximately 1/16 inch high by ⅜ inch wide. Each of the solar cells 48 and 85 each view one of a plurality of contiguous portions of the viewed areas located respectively within the upper viewing zone 52A and the lower viewing zone 52B.

Each of the lamps 72 and 74 is provided with a hood 87 disposed so as to prevent direct illumination of the viewing zone 52B which extends substantially centrally through the color viewer. Therefore, as best seen by the illustrative ray paths in FIG. 3A, light from the lamps 72 and 74 is reflected by the upper and lower surfaces of the second viewing chamber defined within the viewing assembly 20 to illuminate the viewing zone 52B. When no article is in the viewed area 50B of the viewing zone 52B, the solar cells 85A, 85B, and 85C associated within the color sensing element 78 receive reflected light energy from the background member 84. As seen in FIGS. 3 and 3A, it may be advantageous or desirable to dispose a filter 90 within the color sensing element 78. Such a filter 90 may be used to accentuate differences in color between the glass particles. For example, a blue filter passes only blue light. A green or amber glass particle transmits or reflects little, if any, blue light. A clear glass particle, of course, transmits or reflects all colors. Thus it will be appreciated that such green or amber particles would appear to the solar cells 85 as very dark compared to a clear glass particle when viewed through a blue filter. It is again understood that, although the lamps 72, 74 have been described as incandescent, any suitable illumination means compatible with the requirements of a particular sort may be utilized. It will further be understood that the use of solar cells 48 and 85 is illustrative and that other light-sensitive elements, such as photocathodes, may be utilized with the skill of this art.

As seen in FIG. 3A, ejector elements 24 and 25 are securely affixed to the bottom of the viewing assembly 20 and are oriented 180° apart in substantially the same plane. The ejectors 24 and 25 are disposed to eject selected particles from the particle stream as such particles pass from the viewing zone 52 within the viewing assembly 20. The ejectors 24 and 25 are associated in a manner to be more fully disclosed herein with the classification and control circuitry and respond to ejection signals to actuate one or the other of the ejectors 24 or 25 to guide selected ("unacceptable") particles into the appropriate chutes 28 and 30 (FIG. 1). Thus, one of the ejector elements 24 is associated with the first (opaqueness) classifying means while the other ejector element 25 is associated with the second (color) classifying means. It is a feature of this invention to provide circuitry which permits actuation of only the opaqueness ejector in the instance where a particular particle generates an eject ("unacceptable") signal classification from both the first opaqueness sensing element 44 and the second color sensing element 78.

Referring now to FIG. 4, a diagrammatic illustration of the electronic circuitry associated with the structural elements described hereinabove and embodied by a sorting apparatus exhibiting the teachings of this invention is shown.

The predetermined viewed area 50A (as defined by the optical frame 53) within the upper viewing zone 52A is shown as lying intermediate between the background lamp 34 and the solar cells 48A, 48B, and 48C associated with the opaqueness sensing element 44. Similarly, the predetermined viewed area 50B (as defined by the optical frame 82) within the lower viewing zone 52B is shown as located intermediate between the background member 84 and the solar cells 85A, 85B, and 85C associated with the color sensing element 78. Due to the pancake arrangement of the opaqueness classifying means with respect to the color classifying means, a predetermined distance (indicated diagrammatically as $D_1$ in FIG. 4) lies between the viewed area 50A defined within the upper viewing zone 52A and the viewed area 50B defined within the lower viewing zone 52B. A predetermined distance (indicated diagrammatically on FIG. 4 by $D_2$) lies between the viewed area 50B defined within the lower viewing zone 52B and the ejector elements 24 and 25. A predetermined distance (indicated diagrammatically on FIG. 4 by $D_3$) lies between the viewed area 50A defined within the upper viewing zone 52A and the ejector elements 24 and 25. It is understood that the dimensions shown are illustrative only and are not intended as limiting in any way the invention disclosed herein.

Directing attention to the circuitry associated with the opaqueness sensing element 44 and the classification performed while particles pass through the viewed area 50A defined within the upper viewing zone 52A, it is seen that each of the solar cells 48 is connected through respective leads 49A, 49B, and 49C to an amplifier 100 and to individual amplifying elements 100A, 100B, and 100C disposed therein. The outputs of the amplifiers 100 are connected to a comparator network 102 comprising individual comparator elements 102A, 102B, and 102C. Connected to the non-inverting inputs of each of the comparator elements 102 is a predetermined reference signal functionally related to the magnitude of the signals generated by each of the solar cells 48 when light energy incident thereon from the background lamp 34 is not intercepted by the passage of opaque particles through the viewed area 50A defined within the upper viewing zone 52A. The output of each of the comparators 102 is connected to a logic element 104 comprising, for example, an OR gate.

Referring now to the output leads 86A, 86B, and 86C emanating respectively from the solar cells 85A, 85B, and 85C associated with the color sensing element 78, it is seen that each of the solar cells is connected to an amplifier 110 including individual amplifier elements 110A, 110B, and 110C. The outputs of the amplifiers 110 are connected to a comparator network 112 including individual comparator elements 112A, 112B, and 112C. The non-inverting inputs of each of the comparators 112 is connected to a reference signal functionally related to the magnitude of the light energy incident upon each of the solar cells 85 as reflected from the background member 84 when no particles are in the viewed area 50B defined within the lower viewing zone 52B. The output of the comparators 112 are connected to a logic element 114 comprising, for example, an OR gate.

The output of the logic elements 104 and 114 are coupled to signal delay means, such as signal delay elements indicated respectively by reference numerals 116 and 118. Each of the signal delay elements 116 and 118 is coupled electrically to a suitable clock. As indicated in FIG. 4, both clocks deliver timing pulses to their respective delay elements from local oscillators running at predetermined frequencies. The delay elements 116 and 118 may, for example, be implemented by 200 bit registers such as those manufactured and sold by National Semiconductor under the manufacturers number MM5006A. It will be appreciated that due to the differences in the respective distances $D_3$ and $D_2$ between the area 50A viewed by the opaqueness sensing element 44 and the area 50B viewed by the color sensing element 78 and the ejector elements 24 and 25, signals generated in the opaqueness viewing section of the viewing assembly 20 are delayed for a period of time longer than the time that signals generated in the color viewing section are delayed.

In practice, it has been found that storage times of approximately 12 to 15 milliseconds for opaqueness classification signals and approximately 8 to 12 milliseconds for color classification signals are the times required in order to permit particles classified as opaque and colored, respectively, to negotiate the distance from their respective viewed areas 50A and 50B to the proximity of the ejectors 24 and 25. The frequencies of the clock signals provided to the delay elements 116 and 118 will determine the periods of time after which signals presented at the inputs of the respective delay elements will appear at the outputs thereof. Classification signals from the opaqueness and the color viewers appear on lines 120 and 122, respectively, connecting the outputs of delay elements 116 and 118 to actuator circuits 124 and 126. As seen in FIG. 4, the actuator circuits 124 and 126 are respectively coupled to the ejector 24 (associated with the opaqueness viewer) and to the ejector 25 (associated with the color viewer).

It will be understood that actuation signals may appear simultaneously at the outputs of the respective delay elements 116 and 118. For example, if a particular particle to be sorted exhibits both sufficient opaqueness and sufficient color, eject signals will be generated on the electronic channels associated with the opaqueness and color viewers. To prevent the actuation of both ejector elements 24 and 25 in such a situation, an inhibitor circuit generally indicated by reference numeral 130 is operatively connected through lines 132 and 134 with the actuator circuits 124 and 126, respectively. The inhibitor circuit 130 is operable in the situation where actuation output signals from the delay elements 116 and 118 are simultaneously presented to the actuator circuits 124 and 126. The inhibitor circuit 130 acts to prevent the firing of the ejector 25 associated with the color viewing element and to permit actuation of only the ejector 24 associated with the opaque viewer. It may therefore be appreciated that an accurate three-way sort of particles from a singulated particle stream can be effected. In the case of glass particles, a three-way sort into clear, colored, and opaque categories may be effected with only one pass of the particle stream through the viewing assembly 20.

Figure 5:
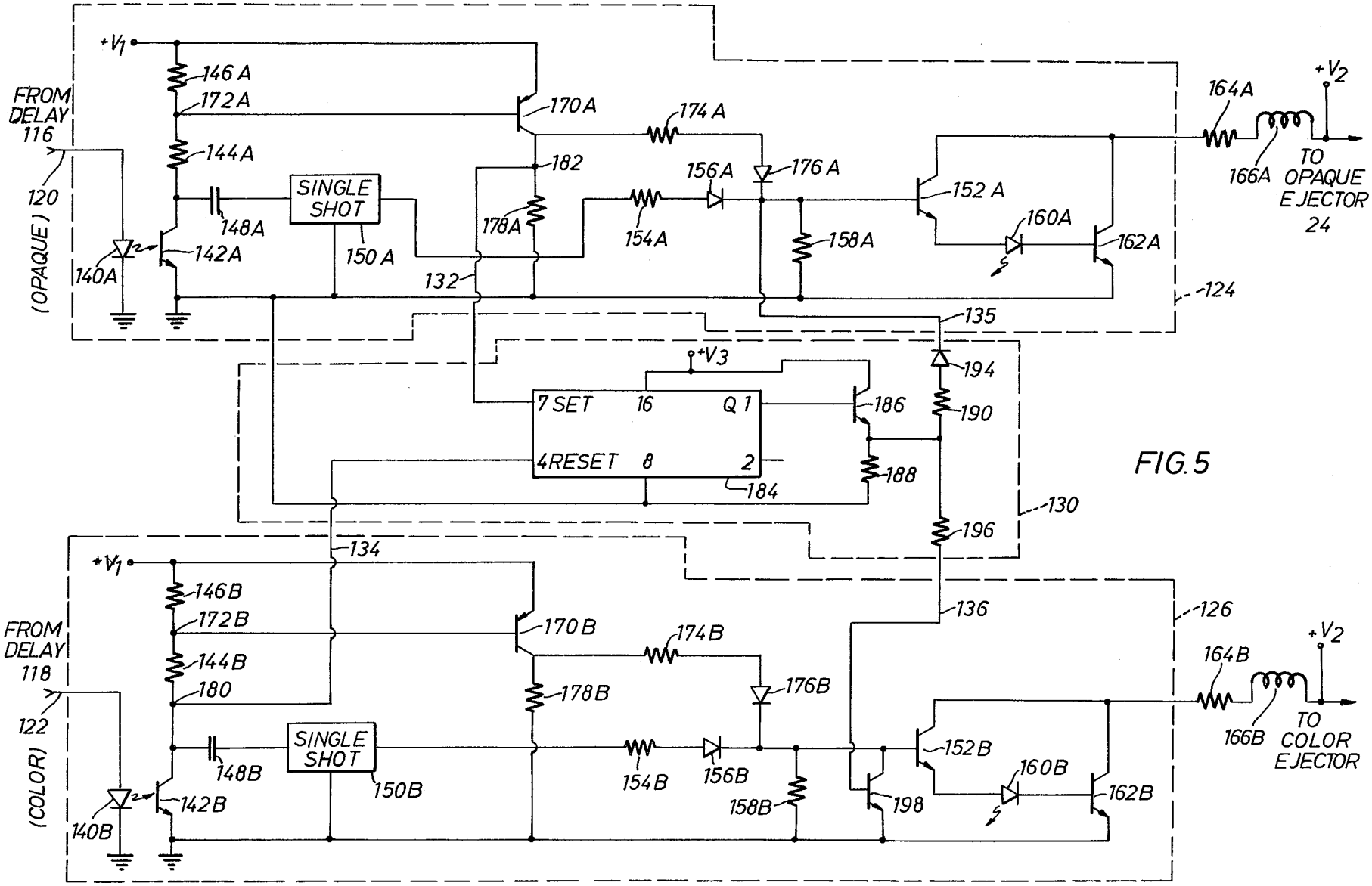
FIG. 5 is a schematic diagram of actuator and inhibitor circuitry utilized in a sorting apparatus embodying the teachings of this invention; and, FIG. 6 is a logic truth table associated with the inhibitor circuitry of FIG. 5.

Referring now to FIG. 5, a schematic diagram of the actuator circuits 124 and 126 and the inhibitor circuit 130 is shown. Since the circuits of actuators 124 and 126 are substantially similar, attention is first directed to these elements. Signals which actuate one or the other of the actuator circuits 124 and 126 are presented, respectively through lines 120 and 122. The lines 120 and 122 are respectively connected to the anodes of light emitting diodes (L.E.D.'s) 140A and 140B. The bases of light sensitive NPN transistors 142A and 142B receive the light from the L.E.D.'s 140A and 140B. The emitters of the transistors 142 are coupled to ground and the collectors are tied through resistors 144A and 144B and 146A and 146B to a positive voltage source $V_1$. The collectors of the transistors 142A and 142B are respectively coupled through capacitors 148A and 148B to the inputs of single shot multivibrators 150A and 150B. The outputs of the single-shots 150 are tied to transistors 152A and 152B of the NPN type through resistors 154A and 154B and through diodes 156A and 156B. The bases of the transistors 152 are tied to ground through resistors 158A and 158B. The emitters of the transistors 152 are coupled through light emitting diodes (L.E.D.'s) 160A and 160B to the bases of transistors 162A and 162B of the NPN type. The emitters of the transistors 162 are tied to ground. Resistors 164A and 164B and solenoids 166A and 166B are tied to the collectors of the transistors 162. The solenoids 166 are connected to a positive voltage source $V_2$ and, when energized, actuate the appropriate ejectors 24 and 25 (FIG. 4).

Transistors 170A and 170B of the PNP type are tied between the resistors 144 and 146 at nodes 172A and 172B. The emitters of the transistors 170 are tied to the positive voltage source $V_1$ while the collectors are coupled through resistors 174A and 174B and through diodes 176A and 176B to the bases of the transistors 152. The collectors of the transistors 170 are tied to ground through resistors 178A and 178B.

The inhibitor circuitry 130 is connected by lines 132 and 134 to the actuator circuits 124 and 126, respectively. The line 134 is tied to the collector of the transistor 142B at a node 180 while the line 132 is tied to the collector of the transistor 170A at a node 182. The lines 132 and 134 are respectively connected to pins 7 and 4 of a master-slave flip-flop element such as that manufactured by Fairchild under the manufacturers number F4027, indicated by reference numeral 184. Pins 8 and 16 of the element 184 are respectively connected to ground and to a positive voltage source $V_3$. Pin 7 acts as the SET input while pin 4 is RESET. The functioning of the element 184 is made clear in the discussion which follows herein taken in connection with FIGS. 5 and 6.

Pin 1 corresponds to the Q output. The pin 1 is tied to the base of an NPN transistor 186, the collector of which is tied to the positive voltage source $V_3$ while the emitter is coupled through a resistor 188 to ground. The emitter of the transistor 186 is connected to the base of the transistor 152A in the actuator circuit 124 through a line 135 having a resistor 190 and a diode 194. The emitter of the transistor 186 is also coupled to the actuator 126 by a line 136 having a resistor 196. The resistor 196 is connected to the base of a transistor 198 of the NPN type. The collector of the transistor 198 is connected to the base of the transistor 152B while the emitter is connected to ground.

As explained earlier, the inhibitor circuit 130 is operable to prevent simultaneous actuation of both the ejectors 24 and 25 when a particular particle is classified for ejection by both the opaque and the color classifying means. In the particular embodiment shown in FIG. 5, as seen by the logic truth table disclosed in FIG. 6, this purpose is effectuated by the arrangement hereinbefore disclosed.

Having described the physical structure and electronic circuitry associated with a sorting apparatus embodying the teachings of this invention, the operation thereof may now be readily explained.

Through the action of the hopper 12, chute 14, and slide 16, a singulated stream of glass particles passes in free-fall through the viewed areas 50A and 50B respectively defined within the viewing zones 52A and 52B associated with the opaque and color classifying means of the viewing assembly 20. In the following discussion it is assumed that the stream contains, in series, a clear glass particle, a colored glass particle and an opaque particle.

As the clear glass particle enters the viewed area 50A defined within the viewing zone 52A associated with the opaque classifying means, it is seen that, due to the translucency thereof, light energy from the background lamp 34 is not impeded from impinging upon the cells 48. Therefore, predetermined normal signal levels emanating from these cells remain substantially unaffected by the passage of the clear glass particle. Similarly, the passage of the clear particle through the viewed area 50B defined within the viewing zone 52B does not impede the transmission of reflected light from the background member 84 to the solar cells 85, and the normal signal levels associated therewith remain substantially unaffected. The amplifiers 100 and 110 therefore continue to present the normal voltage or current outputs from the cells 48 and 85 respectively to the comparators 102 and 112. Since no deviation in the signals on any of the lines 49A, 49B or 49C, or 86A, 86B or 86C occurs, no output signal from any of the comparators 102 and 112 is input to the logic elements 104 and 114. Therefore, no trip initiation ("eject") signal is generated by the passage of the clear particle through the viewed areas defined within the viewing zones. The clear particle continues its free-fall path from the terminus of the slide 16 through the accept tube 26 to the clear glass receptacle.

The next particle under consideration, assumed to be a colored glass particle, enters the viewed area 50A defined within the upper viewing zone 52A associated with the opaque classifying means after the first examined particle (the clear particle) has left the viewed areas 50A defined within the viewing zone 52A. It is understood, of course, that no precise distance between the individual serial particles may be maintained but it is generally true that acceleration due to gravity of the particles as they leave the end of the slide 16 spaces the particles apart to permit one and only one particle in the singulated stream to be present within each of the viewed areas 50A and 50B respectively defined within the viewing zones 52A and 52B at one point in time.

The colored particle passes through the viewed area 50A defined within the viewing zone 52A and, since it is substantially translucent, the normal output signals from the solar cells 48 are not diminished by an amount sufficient to trigger an output signal from any one of the comparators 102. However, due to the coloration of the particle under consideration, passage through the viewed area 50B of the color viewing zone 52B results in a diminution of the normal output signals from the solar cells 85 so as to generate an output signal from the comparators 112. Therefore, a trip initiation signal is output on at least one of the lines from the comparators 112 to the logic element 114. The presence of a signal on any one of these inputs to the logic element 114 generates an output thereof which is presented to the signal delay element 118. The duration of the output from the gate 114 is dependent upon the time the particle is in the view of the solar cells 85. The delay circuitry 118 operates to, in effect, hold the color classification of the colored particle for a period of the time sufficient to permit that particle to traverse the distance D2 from the viewed area 50B defined within the viewing zones 52B to the proximity of the ejector 25 (FIG. 4). The delay time within the signal delay element 118 is, as explained above, variably regulated by regulation of the frequency of the clock pulses input thereto.

After a predetermined time delay from the delay element 118, the eject information concerning the colored particle is input through the line 122 to the actuation circuit 126.

Referring to FIG. 5, the trip eject signal, hereinafter assumed to be a positive pulse of predetermined duration, triggers the light emitting diode 140B and thereby biases the transistor 142B to the on condition. Turning the transistors 142B on permits current to flow from the positive volage source $V_1$ through the resistors 144 and 146 to ground. Therefore, the single-shot multivibrator 150B coupled through the capacitor 148B is triggered and a pulse of a predetermined duration is emitted therefrom through the resistor 154B and the diode 156B to the base of the transistor 152B. Simultaneously, due to the conduction of the transistor 142B, the normally high voltage signal present on the base of the transistor 170B decreases and the transistor 170B is turned on. Conduction of the transistor 170B causes current to flow through the resistor 174B (tied to the collector of the transistor 170B) and the diode 176B to the base of the transistor 152B. It will be appreciated that the transistor 152B is presented with a positive signal for at least the period of time associated with the single-shot 150B. Alternatively, through the conduction path from the node 172B, through the transistor 170B and the diode 176B, a current flow may be maintained to the transistor 152B for a period of time equal to the duration of the signal on the line 122.

Turning the transistor 152B on fires the light emitting diode 160B and turns the transistor 162B on, permitting a current to flow through the resistor 164B and the solenoid coil 166B. Energization of the coil 166B opens the valve of ejector 25 so that, substantially coincident with the passage of the colored particle past the ejector 25, a blast of air from the ejector 25 impels that colored particle from the singulated stream into its appropriate chute 28.

It is noted that since no trip indication is generated by the passage of the colored particle through the opaque classifying means, no signal is present on the line 120 from the delay element 116 at any time when the trip signal is present on the line 122. Therefore, as seen in FIG. 6, it may be appreciated that when a colored particle is detected a logic 0 is input through the RESET pin 4 of the element 184 as a result of the conduction of the transistor 142B pulling the point 180 from its normally high voltage condition down to ground potential. Simultaneously, however, a logic 0 is maintained at the set pin 7 of the element 184 due to the connection of that pin 7 to the node 182 in the actuator circuit 124. Since no signal is present on the line 120, conduction of the transistor 142A does not occur and the substantially low voltage level at the collector of the transistor 170A is maintained on the line 132 to the SET pin of the element 184. Therefore, as indicated in the truth table of FIG. 6, the Q output of the element 184 remains low and no inhibition action by the inhibitor circuit 130 occurs. At the end of the signal on the line 122, the normal input conditions to the element 184 are restored.

As the opaque element, the third particle in this series to be considered, enters the viewed area 50A defined within the viewing zone 52A, it is clearly understood that light energy incident upon at least one of the solar cells 48 (depending upon the size of particle) is inhibited and a deviation from the normal output signal of the cells 48 occurs. Such deviation is amplified and compared within the comparator 102. An output signal indicative of the deviation from normal output signals greater than the predetermined threshold as set by the reference voltage generates a trip signal on at least one of the lines to the logic element 104. Therefore, a trip signal is presented to the input of the delay circuit 116. The duration of the output from the gate 104 is dependent upon the time the particle in the view of the solar cells 48.

A period of time later, during which time the opaque particle has traveled from the viewed area 50A to the viewed area 50B (through the distance D1 in FIG. 4), a deviation from the normal output signals of the cells 85 occurs due to the inhibition of the normal light transmission from the background member 84 to the cells 85. Such deviation is amplified, and, since it exceeds the predetermined reference as set by the comparators 112, a trip initiation signal is output from at least one of the comparators 112 to the logic element 114. This trip initiaton signal is presented to the input of the delay circuit 118. Again, the duration of the output from the gate 114 is dependent upon the time the particle is in the path of the solar cells 85.

Since the trip initiation signal from the opaque cells 48 is received by the signal delay element 116 before the trip initiation signal from the color cells 85 is received by the signal delay element 118, it is clear that the signal delay element 116 must operate to hold the trip signal presented thereto for a longer period of time than the signal delay element 118 holds a trip signal presented thereto. The signal delay elements 116 and 118 are operated by the variable frequency clocks so that the trip signals generated by the opaque particle in both the opaque viewer and the color viewer are simultaneously presented on the lines 120 and 122 to the actuator circuits 124 and 126.

Without the presence of the inhibitor circuit 130, the electronic signals presented to the actuator circuits 124 and 126 would actuate both their associated ejectors simultaneously to cause an unpredictable classification of the opaque particle.

However, due to the connection of the inhibitor circuit 130 it will be appreciated that in the instance under consideration, namely where a trip signal is generated by both the opaque and the color classifying means, conduction of both the transistors 142A and 142B occurs. Condition of the transistor 142B has, as previously, discussed, the result of changing the input on the line 134 from its normally high level to a logic low. As a result the RESET pin number 4 is input with a logic low or logic 0 signal. Simultaneously, conduction of the transistor 142A turns on the transistor 170A to change the normally low signal on the line 132 to the SET pin 7 to a logic high or logic 1 signal. As seen from the truth table of FIG. 6, a high or logic 1 on the SET pin 7 and a low or logic 0 on the RESET pin 4 results in a high output or logic 1 on the Q pin 1. Such an output (Q pin being high) turns the transistor 186 on and permits current flow through the resistor 190 and the diode 194 on the line 135 to provide a positive signal to the base of the transistor 152A to actuate the ejector 24.

Conduction of the transistor 186 also causes current to flow through the resistor 196 in the line 136 into the actuator 126 to turn on the transistors 198 to effectively short-circuit the base of the transistor 152B to ground. Therefore, any actuation signals from the single shot 150B or from the diode 176B-transistor 170B path is effectively shorted to ground to prevent energization of the coil 166B. Therefore, it may be seen that in such an instance (where a particle generates trip signals from both the opaque and the color classifying means) the acton of the inhibitor circuit 130 permits energization only of the ejector 24 associated with the opaque classifying means and to expel that opague particle from the particle stream through its appropriate chute 30. When the signals on the lines 120 and 122 end, the normal input conditions to the element 184 are restored.

It is appreciated that the sorting apparatus is arranged so that a color trip signal can be generated without generating an opaque trip signal. This is so since a signal diminution from the cells 85 sufficient to generate a trip signal from the color classifying means is not necessarily sufficient to generate a trip signal from the opaque classifying means. However, the converse is not true. It is not possible in the circuitry arrangement above discussed to have an opaque trip signal and not a color trip signal because a diminution sufficient to generate a trip signal from the opaque classifying means is also sufficient to generate a trip signal from the color classifying means.

In summary, it is therefore clearly seen that the apparatus embodying the teachings of this invention provides a three-way sort of a singulated stream of glass particles with only one pass through the viewing assembly 20 and permits a highly accurate elimination of opaque and colored glass particles from the particle stream. Clear glass is permitted to pass unimpeded to an appropriate collection receptacle. It is also seen that through the provision of electronic circuitry, inhibition of the ejector 25 is effected to permit actuation of only the the ejector 24 in the case where ejection signals from both the opaque and the color classifying means are generated.

Due to the stacked configuration of the opaque and color classifying means, it is understood that an opaque particle generates a reject signal from the opaque viewer earlier than the opaque particle generates a reject signal from the color viewer. This occurs because the particle passes the opaque viewer before it passes the color viewer. On a time continuum, therefore, a reject signal from the opaque viewer precedes a reject signal from the color viewer. It should be understood however, that the duration of one of the reject signals (either from the opaque viewer or the color viewer) may be longer than the duration of the other reject signal. This phenomenon occurs for a variety of reasons. At the outputs of the signal delay elements 116 and 118, however, the reject signals are presented to the actuators 124 and 126 at substantially the same time. But due to the possible differences in duration of the signals, one signal on the lines 120 and 122 may end before the other.

In the situation wherein the opaque signal input to the actuator circuit 124 through the line 120 is of a shorter duration than the color signal input to the actuator circuitry 126 through the line 122, it is possible with the inhibitor circuit 130 to avoid the situation of having the color signal ejector 25 inhibited for that period of time that the opaque signal exists and, when the opaque signal ceases, having the color circuitry ejector 25 fire. With reference to the logic truth table of FIG. 6, during that period of time when both the opaque and the color trip signals are present on the lines 120 and 122, the inhibitor circuit 130 operates, as discussed above, to short-circuit the transistor 152B to ground. Thus, for the period of time during which the opaque and color signals co-exist, the color ejector 25 is inhibited from firing. However, if the color signal should remain on the line 122 for a time longer than the opaque signal is on the line 120, the transistor 142A is turned off, thus pulling the node 182 from its logic high value (when the transistor 142A is on) to a logic low value when it turns off. Thus, the SET pin 7 is presented with a logic low during the same period of time that the RESET pin 4 is also presented with a logic low due to the continued conduction of the transistor 142B. In such a situation, as seen by the reference to the truth table of FIG. 6, the output Q is a logic high, and thus maintains the previous state at which it is set. Thus, the logic 1 at the Q output of the element 184 is maintained and a signal continues at the transistor 152A even though the SET signal has changed from a logic high to a logic low. At the end of the color signal duration, the transistor 142B is turned off. Thus the RESET pin 4 returns from its low level when the transistor 142B is conducting back to its normal high level. As seen from the truth table of FIG. 6. the Q output goes to a logic 0 to turn the transistor 186 off. The inhibitor circuitry 130 is then in its normal state ready to accept information indicative of the classification of the next particle in the serial train.

If the color signal ends before the opaque signal, that is, if the duration of the opaque signal on the line 120 is longer than the duration of the color signal on the line 122, the following situation occurs. While both signals are present, the Q output is a logic 1, as previously discussed. However, as the color signal ends, logic highs are present on the inputs to both the SET pin 7 and the reset pin 4. The Q output remains high, maintaining conduction of the transistor 186. When the opaque signal ends, the Q output goes low, turning the transistor 186 off, and returning the inhibitor circuitry to its normal state.

We claim as our invention:

1. Apparatus for sorting particles into three groups according to predetermined physical characteristics comprising:

means for providing a singulated stream of particles;

first classifying means including a first viewing zone for classifying each particle passed therethrough according to a first physical characteristic thereof and for generating a first electrical trip signal responsive to a particle having said first physical characteristic;

second classifying means including a second viewing zone for classifying each particle passed therethrough according to a second physical characteristic thereof and for generating a second electrical trip signal responsive to a particle having said second physical characteristic;

a first ejector element associated with said first classifying means and spaced a first predetermined distance therefrom, said first ejector element responsive to said first trip signal to expel a particle having said first physical characeristic from said particle stream;

a second ejector element associated with said second classifying means and spaced a second predetermined distance therefrom, said second ejector element responsive to said second trip signal to expel a particle having said second physical characteristic from said particle stream, said first ejector element and said second ejector element both being disposed in a plane substantially normal to said particle stream and 180° from one another across said particle stream;

first signal delay means disposed intermediate said first classifying means and said first ejector element for delaying a trip signal generated by said first classifying means for a first predetermined period of time functionally related to the time required for a particle to traverse said first predetermined distance;

second signal delay means disposed intermediate said second classifying means and said second ejector element for delaying a trip signal generated by said second classifying means for a second predetermined period of time functionally related to the time required for a particle to traverse said second predetermined distance; and, means responsive to the simultaneous output of trip signals from said first and second signal delay means to said first and second ejector elements for permitting actuation of one of said ejector elements and for inhibiting actuation of said other ejector element.

2. Apparatus according to claim 1, wherein said first predetermined physical characteristic is the opaqueness of a particle and said second predetermined physical characteristic is the color of a particle.

3. Apparatus according to claim 1, wherein said first classifying means comprises a first light sensitive element disposed to view a predetermined area within said first viewing zone and responsive to zones in the intensity of light incident thereon to generate said first electrical trip signal responsive to the presence of a particle having said first physical characteristic within said predetermined area within said first viewing zone.

4. Apparatus according to claim 3, wherein said second classifying means comprises a second light sensitive element disposed to view a predetermined area within said second viewing zone and responsive to changes in the intensity of light incident thereon to generate said second electrical trip signal responsive to the presence of a particle having said second physical characteristic within said predetermined area within said second viewing zone.

5. Apparatus of claim 4, wherein said second classifying means further comprises a filter element selected to attenuate light energy transmitted from a particle passed through said second viewing zone at a predetermined wavelength of the visible spectrum.

6. Apparatus according to claim 4, wherein said first light sensitive element comprises a solar cell.

7. Apparatus according to claim 4, wherein said second light sensitive element comprises a solar cell.

8. Apparatus according to claim 1, wherein said first classifying means comprises:

a first transparent member exhibiting a rectangular cross-section and having said first viewing zone defined therein;

first background illumination means for generating a background illumination level of a predetermined intensity; and, a first light sensitive element disposed to view a predetermined area within said first viewing zone and responsive to said background illumination intensity level to generate an electrial signal functionally related thereto;

said first light sensitive element also being responsive to predetermined changes in the intensity level of light incident thereon to generate said first electrical trip signal responsive to the presence of a particle having said first physical characteristic within said viewed area within said first viewing zone.

9. Apparatus according to claim 8, wherein said second classifying means comprises:

a second transparent member exhibiting a rectangular cross-section and having said second viewing zone defined therein;

second background illumination means for generating a background illumination level of a predetermined intensity; and, a second light sensitive element disposed to view a predetermined area within said second viewing zone and responsive to said background illumination intensity level to generate an electrical signal functionally related thereto;

said second light sensitive element also being responsive to predetermined changes in the intensity level of light incident thereon to generate said second electrical trip signal responsive to the presence of a particle having said second physical characteristic within said viewed area within said second viewing zone.

10. Apparaths according to claim 9, wherein said first light sensitive element comprises a plurality of solar cells each arranged to view one of a plurality of contiguous portions of said predetermined area defined within said first viewing zone.

11. Apparatus according to claim 9, wherein said second light sensitive element comprises a plurality of solar cells each arranged to view one of a plurality of contiguous portions of said predetermined area defined within said second viewing zone.

12. Apparatus for sorting opaque particles and colored glass particles from a stream of particles including opaque particles, colored glass particles, and clear glass particles, comprising:

means for providing a singulated stream of particles;

first classifying means including a first viewing zone for classifying each glass particle passed therethrough according to the opaqueness thereof and for generating a first electrical trip signal responsive to an opaque particle, said first classifying means comprising:

a first transparent member exhibiting a rectangular cross-section and having said first viewing zone defined therein;

first background illumination means for generating a background illumination level of a predetermined intensity; and, a first light sensitive element disposed to view a predetermined area within said first viewing zone and responsive to said background illumination intensity level to generate an electrical signal functionally related thereto;

said first light sensitive element also being responsive to predetermined changes in the intensity level of light incident thereon to generate said first electrical trip signal responsive to the presence of an opaque particle in said viewed area within said first viewing zone;

second classifying means including a second viewing zone for classifying each glass particle passed therethrough according to the presence of color therein and for generating a second electrical trip signal responsive to a colored glass particle;

a first ejector element associated with said first classifying means and spaced a first predetermined distance therefrom, said first ejector element responsive to said first trip signal to expel an opaque particle from said particle stream;

a second ejector element associated with said second classifying means and spaced a second predetermined distance therefrom, said second trip signal to expel a colored glass particle from said particle stream;

first signal delay means disposed intermediate said first classifying means and said first ejector element for delaying a trip signal generated by said first classifying means for a first predetermined period of time functionally related to the time required for a particle to traverse said first predetermined distance;

second signal delay means disposed intermediate said second classifying means and said second ejector element for delaying a trip signal generated by said second classifying means for a second predetermined period of time functionally related to the time required for a particle to traverse said second predetermined distance; and means responsive to the simultaneous output of trip signals from said first and second signal delay means to said first and second ejector elements for permitting actuation of one of said ejector elements and for inhibiting actuation of said other ejector element.

13. Apparatus according to claim 12, wherein said second classifying means comprises:

a second transparent member exhibiting a rectangular cross-section and having said second viewing zone defined therein;

second background illumination means for generating a background illumination level of a predetermined intensity; and, a second light sensitive element disposed to view a predetermined area within said second viewing zone and response to said background illumination intensity level to generate an electrical signal functionally related thereto;

said second light sensitive element also being responsive to predetermined changes in the intensity level of light incident thereon to generate said second electrical trip signal responsive to the presence of a colored glass particle in said viewed area within said second viewing zone.

14. Apparatus of claim 13, wherein said second classifying means further comprises a filter element selected to attenuate light energy transmitted from a colored particle present in said second viewing zone at a predetermined wavelength of the visible spectrum.

15. Apparatus according to claim 13, wherein said first light sensitive element comprises a plurality of solar cells each arranged to view one of a plurality of contiguous portions of said predetermined area defined within said first viewing zone.

16. Apparatus according to claim 15, wherein said second light sensitive element comprises a plurality of solar cells each arranged to view one of a plurality of contiguous portions of said predetermined area defined within said second viewing zone.

* * * * *

UNITED STATES PATENT OFFICE

CERTIFICATE OF CORRECTION

Patent No. 4,096,949 Dated June 27, 1978

Inventor(s) Michael C. Hoover, William C. Long

It is certified that error appears in the above-identified patent and that said Letters Patent are hereby corrected as shown below:

Column 4, line 16 delete "paticle" and insert --particle--.

Column 13, line 29, delete "Condition" and insert --Conduction--.

Column 16, line 11, delete "zones" and insert --changes--.

Column 17, line 57, after "therefrom" insert --said second ejector element responsive to--.

Signed and Sealed this

Sixth Day of February 1979

[SEAL]

*Attest:*

RUTH C. MASON
*Attesting Officer*

DONALD W. BANNER
*Commissioner of Patents and Trademarks*